United States Patent [19]

Haase et al.

[11] Patent Number: 4,747,535

[45] Date of Patent: May 31, 1988

[54] ENVELOPE ASSEMBLY

[75] Inventors: Roger L. Haase, Arlington Heights; Gary W. Fitzgibbons, Prairie View, both of Ill.

[73] Assignee: Uarco Incorporated, Barrington, Ill.

[21] Appl. No.: 50,859

[22] Filed: May 18, 1987

[51] Int. Cl.[4] ..... B65D 27/10

[52] U.S. Cl. ..... 229/69; 229/73; 206/610

[58] Field of Search ..... 229/69, 73; 206/610, 206/612

[56] References Cited

U.S. PATENT DOCUMENTS

| | | | |
|---|---|---|---|
| 2,931,559 | 4/1960 | Hilliard | 229/73 |
| 3,104,799 | 9/1963 | Steidinger | 229/69 |
| 3,312,385 | 4/1967 | Amort | 229/73 |
| 3,360,184 | 12/1967 | Greason | 229/73 |
| 3,411,699 | 11/1968 | Pine et al. | 229/69 |
| 3,419,286 | 12/1968 | Noonan et al. | 206/610 |
| 3,552,641 | 1/1971 | Bell | 229/69 |
| 3,554,438 | 1/1971 | Van Malderghem | 229/69 |
| 3,841,549 | 10/1974 | Wakeman | 229/69 |
| 3,941,307 | 3/1976 | Van Malderghem | 229/69 |
| 4,002,290 | 1/1977 | Van Malderghem | 229/69 |
| 4,157,759 | 6/1979 | Dicker | 229/69 |
| 4,190,162 | 2/1980 | Buescher | 206/625 |
| 4,418,865 | 12/1983 | Bowen | 229/69 |

FOREIGN PATENT DOCUMENTS 1354196 5/1974 United Kingdom .

*Primary Examiner*—Willis Little

*Attorney, Agent, or Firm*—Wood, Dalton, Phillips, Mason & Rowe

[57] ABSTRACT

An envelope assembly including first and second plies 10, 70 respectively defining a front and back of an envelope along with an intermediate insert ply 40 having a message section 50 and an attachment section 52 with the message section 50 being connected by a small frangible tie 56 to the attaching section 52. A U-shaped glue line 84 secures the first and second plies 10, 70 together and one of the plies 10, 70 is provided with a tab 22 firmly secured to the attaching section 52. The ties 56 provide registration during manufacture and subsequent printing and yet are easily ruptured when the tab 22 is stripped from the form, taking the attachment section 52 with it to thereby free the message section 50 for ready removal from the envelope.

9 Claims, 2 Drawing Sheets

ENVELOPE ASSEMBLY

FIELD OF THE INVENTION

This invention relates to continuous business form assemblies, and more particularly to continuous business form envelope assemblies wherein the envelope may serve to carry so-called variable information to a recipient which information is printed on an insert within the original envelope through the envelope itself.

BACKGROUND OF THE INVENTION

In U.S. Pat. No. 3,104,799, issued Sept. 24, 1963 to D. J. Steidinger, there is described the first truly practical continuous business form mailing assembly. Steidinger's invention, as therein disclosed, involved sandwiching insert material between two elongated plies of paper constituting the front and the back of the mailing assembly. The insert material was die cut so as to be free of attachment to the envelope on three sides and yet be continuous on the fourth side. This enabled the insert material to be properly registered within the envelope so that it could be printed upon, by image transfer material within the envelope itself, by an impact printer. Steidinger's invention was a huge success and it is still considered the best form of its type available because of the ability to maintain registration of the insert material within the envelope during printing.

The Steidinger envelope could be opened by use of a tear strip on the side of the envelope whereat the insert was continuous. Tearing across that edge of the envelope, generally along lines of perforation provided to facilitate the same, broke the attachment of the insert side to the envelope, thereby freeing the insert material for extraction.

The recipient of the insert could then bow the envelope and reach into the same to grasp the insert material and remove it from the envelope. In many cases, thumb notches were provided in association with the tear strip such that the thumb notches would be removed with the tear strip allowing one to grasp the insert material at the location of the thumb notches.

Other forms of opening devices were also suggested. In U.S. Pat. No. 3,554,438 issued Jan. 12, 1971 to Van Malderghem, the insert was die cut so as to be free of attachment to the envelope on three sides as in the Steidinger construction. However, the continuous fourth side was located oppositely of the tear strip and a so-called "keen" perforation located between the main body of the insert and its continuous margin.

In addition, the edge of the insert opposite the keen perforation extended through and overlapped the tear strip on the opposite side of the envelope. Thus, one wishing to open the envelope could grasp the same on opposite sides and snap loose the tear strip. This force was usually enough to break the keen perforation connecting the insert material to the envelope and the frictional force applied at the tear strip while grasping the same would remove the insert material from the envelope.

Another example of a similar form of envelope is found in U.S. Pat. No. 3,841,549 issued Oct. 15, 1974 to Wakeman.

While these envelopes work well for their intended purposes, as a practical matter they are generally limited to use with side opening envelopes. Moreover, there may be instances wherein the user of the envelope does not wish the recipient to have to perform the opening of the envelope and the extraction of the insert in two steps (as in Steidinger) or even in a single step as in Van Malderghem or Wakeman; but rather, desires that the opening of the envelope expose a substantial part of the insert material to the recipient, while freeing the insert material from the envelope but yet, without partially or fully extracting the insert material from the envelope. This may be, for example, particularly desirable in the case of a top opening envelope in contrast to the typical side opening envelopes proposed by the patentees identified above.

At least one effort has been made to provide a top opening envelope wherein the opening of the envelope exposes a portion of the insert material without removing the same from the envelope. However, in the known construction, the insert material, even prior to the opening of the envelope, is free from the envelope and thus the user may experience registration difficulties. In particular, the insert material may shift within the envelope with the consequence that subsequently printed variable information may appear at the wrong location on the insert.

Steidinger also envisioned that his mailers might contain more than simply variable information intended for a recipient. Thus, in one embodiment, Steidinger proposed that the original mailer include a return envelope. Consequently, the original mailer could be utilized for posting a bill to a customer and payment of bill could be made utilizing the return envelope.

The desirability of thus providing some sort of return mailing piece with the original mailer was quickly recognized. At the same time, the bulk of the assembly including the return envelope as proposed by Steidinger was considered to be somewhat undesirable in terms of increased cost of fabrication and difficulties in achieving desired "carbonization", that is, the achieving of crisp images through image transfer material on lowermost plies of the assembly, because it was recognized that the thicker the assembly, the more difficult obtaining proper carbonization was. Similarly, it was considered that some of the cost of materials could be eliminated if the return mailer were not wholly separate from the original mailer.

Thus, Amort, in U.S. Pat. No. 3,312,385 issued Apr. 4, 1967 proposed an envelope assembly including a return mailer wherein the back of the original mailer also constituted the back of the return mailer. This saved one ply of paper, reduced manufacturing costs by eliminating such ply, and improved carbonization by reducing the thickness of the assembly by one ply.

Going even further, Pine et al, in U.S. Pat. No. 3,411,699 issued Nov. 19, 1968 disclosed a mailer assembly where the original mailer, after opening and the removal of a tab, also constituted the return mailer. This further reduced manufacturing difficulties as well as the cost of materials and improved carbonization since it amounted to a reduction of two plies from that required by Steidinger and one ply from that required by Amort. The Pine et al invention was readily appreciated by those skilled in the art and a number of variations on the Pine theme have been proposed as found in, for example, U.S. Pat. No. 4,418,865 issued Dec. 6, 1983 to Bowen.

While these assemblies have worked well for their intended purpose, they are not without shortfalls such as mentioned previously. As noted, in a number of instances, registration during printing may not be readily obtainable and/or may require unusual means to attain. Further, ease of opening the envelope and extracting the insert material can provide difficulties in some types of these assemblies.

The present invention is directed to overcoming the foregoing problems.

SUMMARY OF THE INVENTION

It is the principal object of the invention to provide a new and improved continuous envelope assembly. More specifically, it is a principal object of the invention to provide an envelope assembly that is easily manufactured, has good carbonization, requires a minimum number of plies, is easy to open to expose, but not extract the insert material and which positively maintains registration of the insert material during manufacture and subsequent printing by the customer.

An exemplary embodiment of the invention, in one facet of the same, achieves the foregoing objects in a structure including first and second plies respectively defining a front and a back of an envelope. An intermediate insert ply is located between the first and second plies and has a message section and an attachment section. The attachment section and the message section are connected by at least one small frangible tie extending across a slit which otherwise completely severs the sections. Means including a U-shaped glue line secure the first and second plies together and the attaching section to one of the first and second plies with the message section nested within the U-shaped glue line. A tab is formed at least in part in the one ply and is affixed to the attaching section. The tab is defined by two breakable connections, including at least one line of weakening in the one ply, to the first and second plies with the connections being offset from one another so that upon removal of the tab by breaking of the connections, the insert will be exposed.

The tie provides for positive registration during manufacture and printing while the securing of the attaching section to the tab assures that the attachment will be broken in the process of opening the envelope to completely free the insert for ready removal.

Preferably, where the assembly is intended to act at least in part as a return envelope as well, the removal of the attaching portion section leaves the other of the first and second plies with a flap. This flap is foldable and allows the structure constituting at least one of the first and second plies to be used as at least part of a return envelope, which is to say that at least part of the original mailer is reused as a return envelope. Generally, the structure constituting the first and second plies will be used as a return envelope.

Because the number of plies is minimized, material and production expense in making the assembly is minimized and processing is eased with good carbonization obtained.

In a preferred embodiment, the tab is wholly formed in the one ply by the line of weakening and is connected to the other ply by an easily broken adhesive bond. The attachment section is also connected to the other ply by an easily broken adhesive bond and the flap is provided with an adhesive as, for example, a remoistenable adhesive, for securing the flap to the other ply to close the return envelope.

The invention contemplates specifically that the line of weakening extend from side to side across the ply in which it is located and that preferbly, such ply is the front ply.

The invention also contemplates, in another facet thereof, an envelope assembly including a first ply having four edges and defining one of the front and the back of an envelope and having a line of weakening extending across the same spaced from an edge thereof to define a tab removable along the line from the remainder of the first ply. The assembly includes a second ply defining insert material for the envelope. The second ply has three edges located within corresponding edges of the first ply and a fourth edge substantially coextensive with the fourth edge of the first ply and aligned therewith. The second ply includes a slit substantially, but not entirely, severing the same to divide the second ply into a message section and an attaching section. The attaching section includes a portion of the first edge and underlies the tab. A third ply defining the other of the front and the back of the envelope is provided and with the first ply sandwiches the second ply. The third ply has four edges substantially coextensive with the four edges of the first ply and aligned therewith.

The assembly is completed by means securing the plies together including a U-shaped line of relatively strong adhesive located to the side of the line of weakening opposite the tab and securing the first and third plies together while defining a first pocket partially containing the message section. Relatively strong adhesive is also provided for securing the attaching section to the tab and a relatively weak adhesive is utilized to secure the tab to the third ply and the first ply to the third ply to define a second pocket containing the remainder of the message section.

According to this embodiment, the slit is a continuous slit save for the presence of at least one small frangible tie interconnecting the attaching section and the message section at a location on the tab side of the line of weakening.

A highly preferred embodiment contemplates the slit be generally parallel to the fourth edges and further include an additional slit substantially aligned with the line of weakening and generally transverse to the slit and extending from the message section toward the fourth edge while intersecting the slit so that the slit and the additional slit define the attaching section.

In some cases, the additional slit, particularly when it is a horizontal slit which is to say that it extends in a direction across the form, is also provided with at least one small frangible tie interconnecting the attaching section remainder of the insert material to assist in processing.

The invention further contemplates that there is a part of the second ply between the slit and the fourth edge and the side of the additional slit opposite the attaching section that is secured by the U-shaped glue line to one of the first and third plies and to the other of the first and third plies by additional adhesive.

In a highly preferred embodiment, there is a series of such envelope assemblies in connected relation to define a continuous business form. The plies are elongated and continuous to define the fronts, backs and inserts of the envelope assemblies in the series.

Other objects and advantages will become apparent from the following specification taken in connection with the accompanying drawings.

DESCRIPTION OF THE PREFERRED EMBODIMENT

Figure 1:
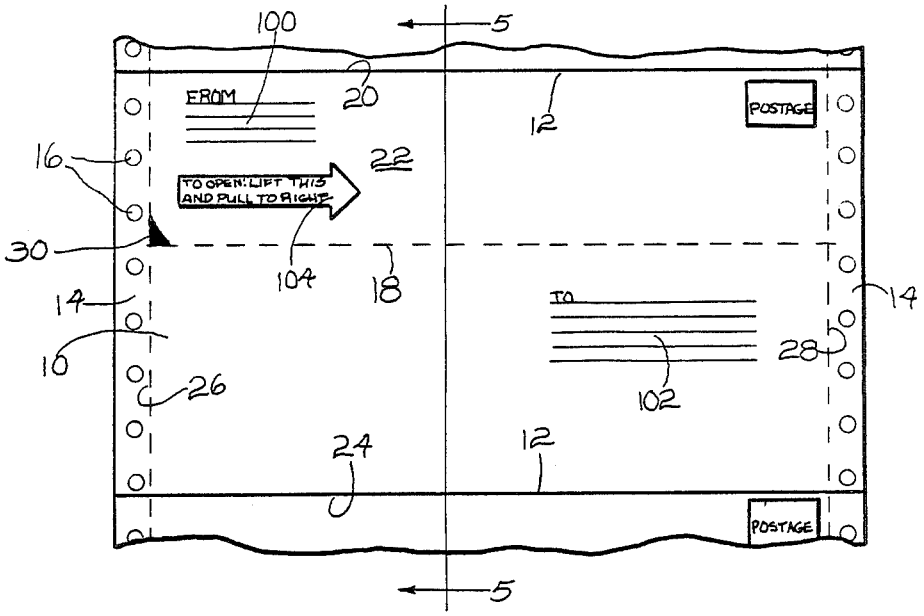
FIG. 1 is a fragmentary, plan view of a continuous envelope assembly made according to the invention and illustrating the front sides of such assembly.

An exemplary embodiment of an envelope assembly made according the invention is illustrated in the drawings in the form of a two-way mailer wherein the plies defining the original mailer envelope also define a complete return envelope structure. However, it is to be understood that the invention herein may be applied to mailers, with or without provision for return mailers that may or may not be formed in part or entirely of components of the original envelope. The preferred embodiment is illustrated in FIG. 1 and is seen to include one elongated ply 10 which constitutes the front of the outgoing mailer. The ply 10 is separated by transverse lines of weakening which delimit individual envelopes in a continuous envelope assembly.

Control punch margins 14 may be disposed on opposite longitudinal sides of the ply 10 and include control punch opening 16 for utilization in manufacture and in subsequent processing as is well known.

The ply 10 also includes transverse lines of weakening 18, generally a perforation, one for each envelope. The perforation 18, along with the top edge 20 of each individual envelope in the assembly define a removable tab 22.

The ply 10 also includes a bottom edge 24 opposite the edge 20 and side edges 26 and 28 which result when the control punch margins 14 are removed from the assembly as by trimming or other conventional processing.

Adjacent the left hand control punch margin 14 and intersecting the edge 26, a small die cut of triangular shape or any other desired shape 30 may be located to facilitate grasping of the tab 22 for opening of the original mailer as will be seen.

Figure 2:
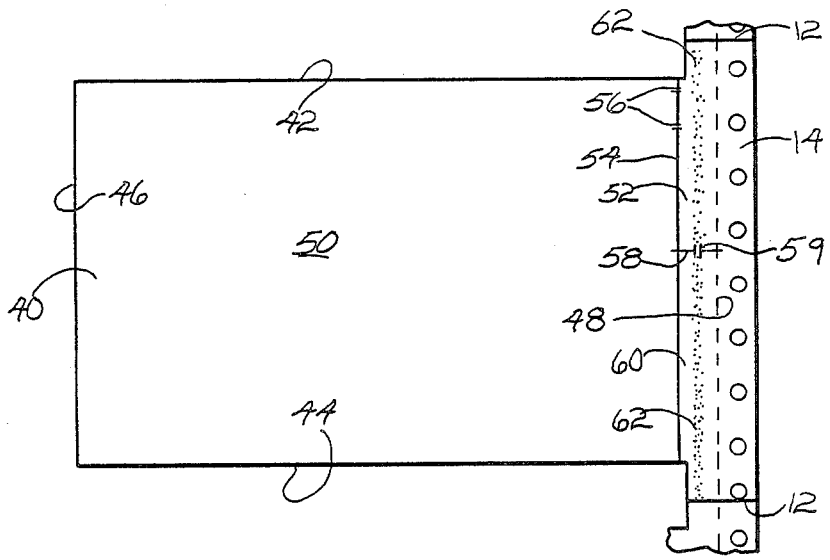
FIG. 2 is a fragmentary view of an insert ply utilized in the envelope assembly.

A typical insert ply 40 is illustrated in FIG. 2 and has three edges 42, 44 and 46 which, as can be seen by overlying FIGS. 1 and 2, are located within the corresponding three edges 20, 24 and 26 of the top ply. The insert ply 40 also includes a fourth edge 48 which is to be substantially aligned with the edge 28 on the top ply and which will exist once the left hand control punch margin 14 on the insert ply is removed. Needless to say, the invention is not limited to the use of a single insert ply, but may employ plural insert plies either as message bearing plies, plies forming part of or the entirety of a return envelope, or both.

The edges 42, 44 and 46 may be formed by die cuts in the same manner mentioned in the previously identified U.S. Pat. No. 3,104,799 to Steidinger. The fourth edge 48 similarly will be continuous and extend across the cross lines of weakening 12 between individual form lengths.

Each insert ply 40 is divided into a message section 50 and an attaching section 52. The latter is separated from the former by a substantially continuous slit 54 which is parallel to the edge 48. That is to say the slit 54 is continuous save for one or more small, frangible ties 56 extending between the attaching section 52 and the message section 50.

The ties 56 serve to hold the message section 50 in registry with the attaching section 52 at all times during manufacture and subsequent processing of the envelope to assure proper registration.

An additional slit 58 is transverse to and intersects the slit 54 and extends from the message section 50 toward the edge 48 such that it will actually intersect the edge 48 when formed after removal of the control punch margin 14. In some cases, particularly where the slit 58 is a so-called "horizontal" slit (meaning that it extends transverse to the length of the continuous business form), the same may be provided with a small frangible tie 59 similar to the ties 56. This prevents one edge of the slit 58 from becoming displaced with respect to plane of the other so that it can conceivably get hung up in manufacturing equipment. The additional slit 58 is aligned with the line of weakening 18 for purposes to be seen.

As a consequence of the presence of the slit 58, the insert ply 40 includes another part 60 which is defined by the edge 48 and the slit 54 and which is on the opposite side of the additional slit 58 from the attaching section 52.

Adhesive 62 is located on both the attaching section 52 and on the part 60. The adhesive 62 on the attaching section 52 thus firmly secures the attaching section 52 to the tab 22. The adhesive 62 on the part 60 secures the part 60 to the remainder of the front ply 10 along the right hand edge thereof.

Figure 3:
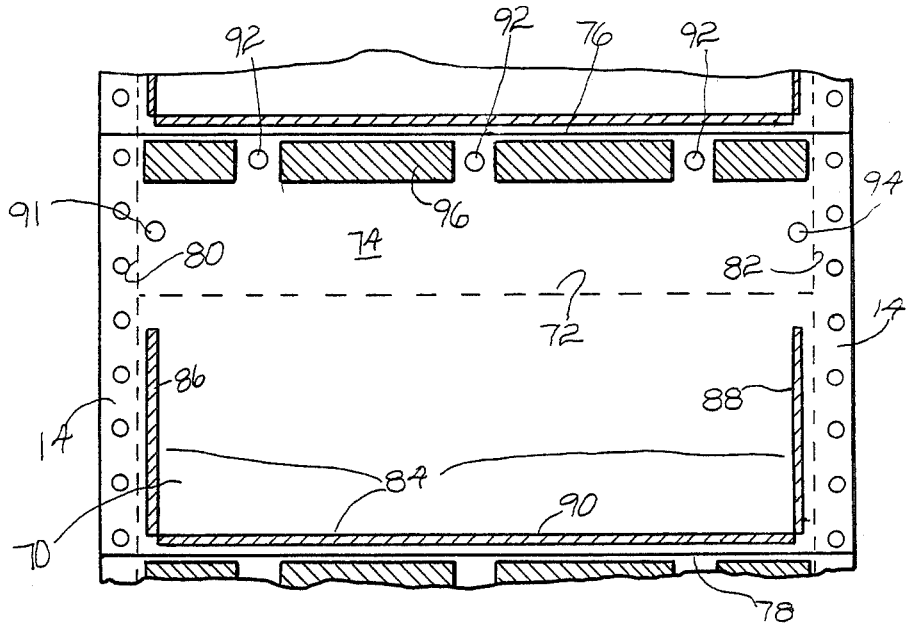
FIG. 3 is a fragmentary view of a ply forming the back of the envelope assembly as viewed from the interior of the envelope, that is, from the front of the envelope.
Figure 4:
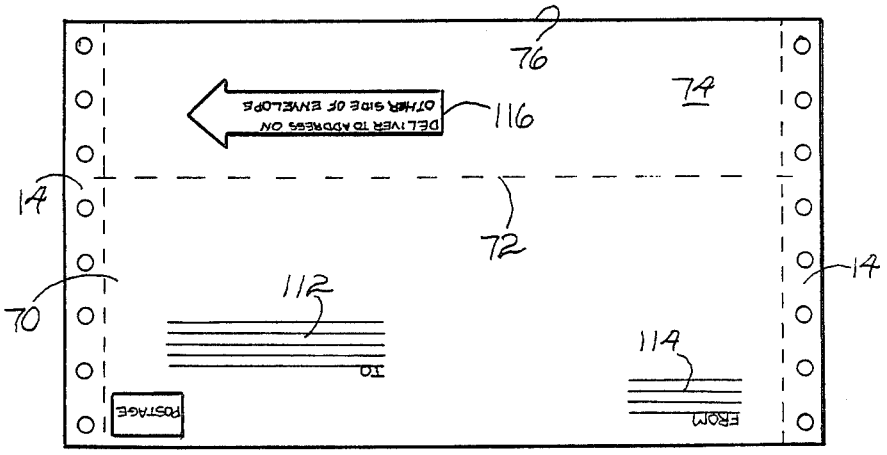
FIG. 4 is a view of the ply forming the back of the envelope assembly taken from the back thereof.
Figure 5:
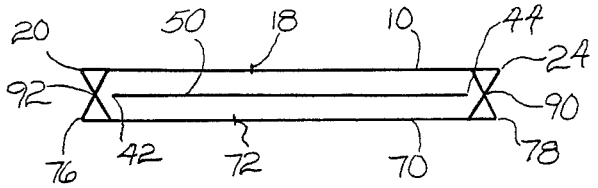
FIG. 5 is a somewhat schematic sectional view taken approximately along the line 5—5 of FIG. 1.

Another ply 70 (FIGS. 3 and 4) defines the back of the envelope. The forward facing side is illustrated in FIG. 3 and the rearward facing side is illustrated in FIG. 4. As best seen in FIG. 3, the back of each individual envelope in the assembly is provided with a fold line 72 which is positioned so as to be parallel to and located just above the line of weakening 18 (FIG. 1). The fold line 72 can be real or imaginary. If real, it may take on the form of a line of perforation, a score line or simply a printed line. If imaginary, there may be no indication of the same at all so long as the recipient of the envelope recognizes that the portion 74 of the ply 70 above the fold line 72 defines a flap for the return envelope and must be folded in the general vicinity of the fold line 72 to seal the return envelope.

Each envelope back within the assembly defined by the ply 70 includes edges 76, 78, 80 and 82 which are alignable and generally coextensive with the edges 20, 24, 26 and 28 respectively in the front of the envelope.

The ply 70 also includes removable control punch margins 14 on opposite longitudinal edges thereof and there is provided a U-shaped glue line 84 formed of a relatively strong adhesive on that portion of the ply 70 below the fold line 72. That is to say, the U-shaped glue line 84 has side sections 86 and 88 that are closely adjacent the edges 80 and 82 respectively but which terminate below the fold line 72 and which are interconnected by a bottom glue section 90 closely adjacent the edge 78. The glue line 84 defines a first pocket which partially contains the message section 50 of the insert ply shown in FIG. 2. A certain portion of the message section 50 will extend above the fold line 72 and that will be housed by a second pocket defined by one relatively small, and thus weak glue spot 91, several similar relatively small, weak glue spots 92 and one relatively small, weak glue spot 94.

The glue spot 91 is located so as to directly interconnect the ply 70 to the ply 10 adjacent the upper portion of the edges 26 and 80. The glue spots 92 connect the plies 10 and 70 along the edges 20 and 76. The glue spot 94 connects to the attaching section 52 on the side thereof opposite that illustrated in FIG. 2. In many instances, the glue spots 91 and 94 may be omitted entirely. Particularly when the glue spot 91 is omitted, the envelope may be easier to open through use of the die cut 30.

The glue sections 86 and 90 connect directly to the ply 10 along the lower portion of the edges 26 and 80 as well as along the edges 24 and 78. The glue section 88 connects to the part 60 of the ply 40 on the side thereof opposite that illustrated in FIG. 2.

Near the edge 76, the flap 74 may be provided with spots of adhesive 96 as, for example, a remoistenable adhesive, so that the flap 74 may be sealed against a part of the first ply 10 as will be seen for return envelope purposes.

In the usual case, variable information will be placed on the first ply 10 and on the insert ply message bearing section 50 in a conventional fashion. The printing may include the printing of a return address in the area 100 on the first ply 10 or the same may be preprinted. The printing will definitely include the printing of addressee information at the area 102 on the ply 10. An opening instruction 104 will be preprinted on the front of the envelope adjacent the triangular die cut 30.

After that is done, the control punch margins 14 will be stripped from the assembly and the envelopes burst from their serial connection at the cross lines 12. The individual envelopes are then placed in the mail. Upon receipt of the mailer in the mail, and upon reading the instruction contained in the area 104, the recipient will lift the tab 22, usually by grasping it at the triangular die cut 30 and pull the same to the right as directed by the instructions. Because the glue spots 92 are relatively weak, the adhesion of the tab 22 to the flap 74 will readily break. When the tab is almost fully pulled to the right, it will encounter its adhesion to the attaching section 52 by a much stronger glue line. Thus, the adhesion of the tab 22 to the attaching section 52 will not break. However, because the attaching section 52 is secured to the flap 74 only by the weak glue spots 94, it is free to break at that location and at the same time, the relatively weak frangible ties 56, and 59 if used, will rupture. Thus, the attaching section 52 will remain secured to the tab 22 and the tab 22 will be totally free from the envelope, opening the same and exposing the upper part of the message section 50 for easy extraction from the envelope. The message section can be easily extracted because in the process of removing the tab, the message section 50 has been totally freed from attachment to the envelope.

Figure 6:
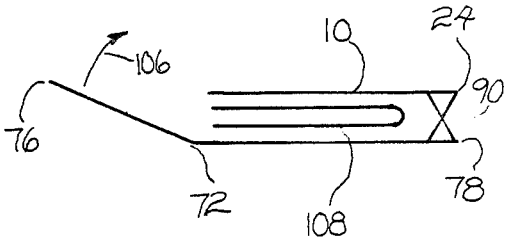
FIG. 6 is a somewhat schematic view illustrating the use of the envelope assembly as a return mailer.

When it is desired to reuse the mailer, the adhesive spots 96 need only be moistened and the flap 74 folded at the fold line 72 as illustrated in FIG. 6 in the direction of an arrow 106 to overlie part of the remaining portion of the ply 10 to contain a return mailing 108 within the pocket defined by the U-shaped glue line 84.

In this connection, the exterior side of the back of the envelope defined by the ply 70 may include preprinted return envelope addressee information in an area 112 as well as a location for the recipient of the original mailer to insert a return address. Such a location is shown at 114. Above the fold line 72, delivery directions as shown at 116 may be located.

With delivery directions such as shown at 116, the addressee information to be contained in the area 112 may be preprinted. If desired, other locations may be used for the same purposes.

When the envelope is originally sent to the intended recipient, the delivery directions contained in the area 116 as illustrated requests delivery be to the addressee on the opposite side of the envelope, that is, to the address appearing in the area 102 on the ply 10. Thus, the postal service cannot become confused by preprinted address information in the area 112 on the back of the envelope.

At the same time, when the envelope is in its return mailer configuration, it will be appreciated that the delivery information contained in the area 116 will now be overlying part of the ply 10 below the line of weakening 18 and will thus direct the postal authorities to deliver to the address shown in the area 112.

Sometimes, but not always, it will be desirable to configure the flap 74 to have sufficient length from top to bottom so that, when folded over the ply 10, it will totally obscure any preexisting addressee information contained in the area 104 to eliminate any source of confusion on the part of the postal authorities in delivering the return mailer.

From the foregoing, it will be appreciated that a two-way envelope assembly made according to the invention eliminates many difficulties with such assemblies as heretofore known. For example, it requires only minimal number of plies since both the front and back of the original mailer are utilized for the same purpose in the return mailer. This simplifies manufacturing and minimizes material expense. It further improves processing as for example, improving carbonization.

At the same time, the unique arrangement of the slit 54, ties 56 and the associated attaching section 52 as well as attachment to the plies of the envelope and to the removable tab 22 assure positive registration of the message bearing section 50 of the insert material during both manufacture and subsequent printing while allowing easy and positive extraction in the hands of a recipient.

We claim:

1. An envelope assembly comprising first and second plies respectively defining a front and a back of an envelope;

an intermediate insert ply between said first and second plies and having a message section and an attachment section, said attachment section and said message section being connected by at least one small, frangible tie extending across a slit otherwise completely severing said sections;

means including a U-shaped glue line securing said first and second plies together and said attaching section to one of said first and second plies with said message section nested within said U-shaped glue line; and a tab formed at least in part by said one ply and affixed to said attaching section, said tab being defined by two breakable connections, including at least one line of weakening in said one ply, to said first and second plies with said connections being offset from one another so that upon removal of said tab by breaking said connections, said insert will be exposed and said attaching section removed.

2. The envelope assembly of claim 1 wherein said tab is wholly formed in said one ply by said line of weakening and is connected to said other ply by a releasable adhesive; said attachment section also being connected to said other ply by releasable adhesive.

3. The envelope assembly of claim 2 wherein said line of weakening extends from side to side across said one ply.

4. The envelope assembly of claim 3 wherein said one ply is said first ply and said other ply is said second ply.

5. An envelope assembly including a first ply having four edges and defining one of the front and the back of an envelope and having a line of weakening extending across the same spaced from an edge thereof to define a tab removable along said line from the remainder of said first ply;

a second ply defining insert material for said envelope and having three edges located within corresponding edges of said first ply and a fourth edge substantially coextensive with the fourth edge of said first ply and aligned therewith, said second ply including a slit substantially, but not entirely severing the same to divide said second ply into a message section and an attaching section, said attaching section including a portion of said fourth edge and underlying said tab;

a third ply defining the other of the front or the back of said envelope and, with said first ply, sandwiching said second ply, said third ply having four edges substantially coextensive with the four edges of said first ply and aligned therewith and a fold line aligned with said line of weakening; and means securing said plies together including a U-shaped line of relatively strong adhesive located to the side of said line of weakening opposite said tab and securing said first and third plies together while defining a first pocket partially containing said message section; relatively strong adhesive securing said attaching section to said tab, and relatively weak adhesive securing said tab to said third ply and said first ply to said third ply to define a second pocket containing the remainder of said message section.

6. The envelope assembly of claim 5 wherein said slit is a continuous slit save for the presence of at least one small, frangible tie interconnecting said attaching section and said message section at a location on the tab side of said line of weakening.

7. The envelope assembly of claim 6 wherein said slit is generally parallel to said fourth edges and further including an additional slit substantially aligned with said line of weakening and generally transverse to said slit and extending from said message section toward said fourth edge while intersecting said slit so that said slit and said additional slit define said attaching section.

8. The envelope assembly of claim 7 wherein there is a part of said second ply between said slit and said fourth edge and on the side of said additional slit opposite said attaching section that is secured by said U-shaped glue line to one of said first and third plies and to the other of said first and third plies by additional adhesive.

9. A series of said envelope assemblies of claim 5 in connected relation to define a continuous business form, said plies being elongated and continuous to define the fronts, backs and inserts of the envelope assemblies in the series.

* * * * *